US011731428B2

(12) United States Patent
Ruf et al.

(10) Patent No.: US 11,731,428 B2
(45) Date of Patent: Aug. 22, 2023

(54) CAPPING UNIT, MAINTENANCE DEVICE AND PRINTER

(71) Applicant: MOUVENT AG, Solothurn (CH)

(72) Inventors: Roland Ruf, Ehrikon (CH); Dominik Job, Baretswil (CH); Piero Pierantozzi, Grenchen (CH)

(73) Assignee: BOBST MEX SA, Mex (CH)

( * ) Notice: Subject to any disclaimer, the term of this patent is extended or adjusted under 35 U.S.C. 154(b) by 233 days.

(21) Appl. No.: 17/282,327

(22) PCT Filed: Oct. 22, 2018

(86) PCT No.: PCT/EP2018/078917
§ 371 (c)(1),
(2) Date: Apr. 1, 2021

(87) PCT Pub. No.: WO2020/083466
PCT Pub. Date: Apr. 30, 2020

(65) Prior Publication Data
US 2021/0379894 A1 Dec. 9, 2021

(51) Int. Cl.
*B41J 2/165* (2006.01)

(52) U.S. Cl.
CPC ..... *B41J 2/16511* (2013.01)

(58) Field of Classification Search
CPC ..... B41J 2/16511
See application file for complete search history.

(56) References Cited

U.S. PATENT DOCUMENTS 9,227,412 B1 1/2016 Liu et al.
2008/0231655 A1 9/2008 Yamada
(Continued)

FOREIGN PATENT DOCUMENTS

CN 1565845 A 1/2005
CN 102947100 A 2/2013
(Continued)

OTHER PUBLICATIONS

International Search Report dated Jun. 24, 2019, in counterpart International Patent Application No. PCT/EP2018/078917 (2 pages, in English).

*Primary Examiner* — Sharon Polk
(74) *Attorney, Agent, or Firm* — Bookoff McAndrews, PLLC

(57) ABSTRACT

The invention relates to a capping unit (1) for capping at least one printhead (311.1, 311.2, 311.3, 321.1, 321.2, 321.3) of a printer (300), in particular an inkjet printer. The capping unit (1) includes a belt element (2.1, 2.2) having an elongated extent, wherein the belt element (2.1, 2.2) includes at least one flexible cap (3.1, 3.2) for capping the at least one printhead (311.1, 311.2, 311.3, 321.1, 321.2, 321.3), wherein the belt element (2.1, 2.2) features a resting setting and a capping setting and is displaceable from the resting setting to the capping setting and back. The belt element (2.1, 2.2) provides a self-stability section (5.1, 5.2) extending over at least a portion of the belt element (2.1, 2.2)'s elongated extent, wherein in the self-stability section (5.1, 5.2), the belt element (2.1, 2.2) is bendable in a movement plane (13.1, 13.2). In the capping setting, at all positions within the self-stability section (5.1, 5.2), a course of the elongated extent follows a straight line (14.1, 14.2) in the movement plane (13.1 13.2). Furthermore, in the capping setting, at each position within the self-stability section (5.1, 5.2), the belt element (2.1, 2.2) provides a self-stability against bending of the belt element (2.1, 2.2) in a self-stability direction being oriented perpendicular to the straight line (14.1, 14.2) and being aligned in the movement plane (13.1, 13.2). At at least one position within the self-stability section (5.1, 5.2), the belt element (2.1, 2.2) is bendable in the movement plane (13.1, 13.2) away from the straight line (14.1, 14.2) in a
(Continued)

bending direction being oriented opposite to the self-stability direction.

20 Claims, 5 Drawing Sheets

(56) References Cited

U.S. PATENT DOCUMENTS

| | | | | |
|---|---|---|---|---|
| 2008/0246801 | A1 | 10/2008 | Carlson et al. | |
| 2019/0126621 | A1* | 5/2019 | Profaca | B41J 25/34 |

FOREIGN PATENT DOCUMENTS

| | | | |
|---|---|---|---|
| CN | 107206794 | A | 9/2017 |
| CN | 108136779 | A | 6/2018 |
| GB | 2 400 581 | A | 10/2004 |

* cited by examiner

CAPPING UNIT, MAINTENANCE DEVICE AND PRINTER

CROSS-REFERENCE TO RELATED APPLICATION(S)

This is a National Stage under 35 U.S.C. § 371 of International Application No. PCT/EP2018/078917, filed on Oct. 22, 2018, the contents of which are incorporated by reference in its entirety.

TECHNICAL FIELD

The invention relates to a capping unit for capping at least one printhead of a printer, in particular an inkjet printer. Furthermore, the invention relates to a maintenance device for maintenance of at least one printhead of a printer, in particular an inkjet printer, the maintenance device including a capping unit according to the invention for capping the at least one printhead and a service device for servicing the at least one printhead, the service device comprising one or both of a cleaning unit for cleaning the at least one printhead, in particular for cleaning a nozzle of the at least one printhead, and an adjusting unit for adjusting one or both a position and an orientation of the at least one printhead, in particular the nozzle of the at least one printhead. Additionally, the invention relates to a printer, in particular an inkjet printer, the printer including a print bar comprising at least one printhead and a maintenance device according to the invention.

BACKGROUND ART

Capping units pertaining to the above mentioned technical field are known. U.S. Pat. No. 9,227,412 B1 of Xerox Corporation for example discloses a maintenance system for maintaining a scalable printhead array. This system comprises a pair of tracks disposed in parallel and on opposite sides of a printhead array and a shaft extending between the tracks and configured to engage with each track to move along the tracks. Furthermore, the system comprises a plurality of maintenance modules mounted in series along the shaft between the tracks and configured to move along the tracks with the shaft to perform maintenance operations like purging, capping and wiping on a plurality of printheads of the printhead array. The tracks are configured to guide the shaft and the plurality of maintenance modules along a path from a resting position to an operating position. Additionally, the system comprises an actuator configured to move the shaft along the tracks.

Such maintenance systems have the disadvantage that they are complex to construct around the printhead array and that they are voluminous.

SUMMARY OF THE INVENTION

It is the object of the invention to create a capping unit pertaining to the technical field initially mentioned, that can be constructed simpler and more compact.

The solution of the invention is specified by the features of claim 1. According to the invention, the capping unit includes a belt element having an elongated extent, wherein the belt element includes at least one flexible cap for capping the at least one printhead, wherein the belt element features a resting setting and a capping setting and is displaceable from the resting setting to the capping setting and back. Furthermore, the belt element provides a self-stability section extending over at least a portion of the belt element's elongated extent, wherein in the self-stability section, the belt element is bendable in a movement plane, wherein in the capping setting, at all positions within the self-stability section, a course of the elongated extent of the belt element follows a straight line in the movement plane, wherein in the capping setting, at each position within the self-stability section of the belt element, the belt element provides a self-stability against bending of the belt element in a self-stability direction being oriented perpendicular to the straight line and being aligned in the movement plane, wherein at at least one position within the self-stability section, the belt element is bendable in the movement plane away from the straight line in a bending direction being oriented opposite to the self-stability direction.

The capping unit is for capping at least one printhead of a printer, in particular an inkjet printer. Particular advantageously, the capping unit is for capping at least one printhead of an industrial inkjet printer, i.e. an inkjet printer for printing on printing substrates having a width of at least 50 cm, in particular at least 70 cm. Such printing substrates are considered as large printing substrates and can for example be paper webs having a width of at least 50 cm, in particular at least 70 cm, corrugated card board having a width of at least 50 cm, in particular at least 70 cm, or rolls of stickers, the rolls having a width of at least 50 cm, in particular at least 70 cm. Alternatively however, the capping unit can be for capping at least one printhead of any printer or inkjet printer, respectively.

According to the invention, the capping unit includes a belt element having an elongated extent. Thereby, the belt element can consist of one element or more than one element. In one example, the belt element comprises a bendable band. In another example, the belt element comprises a plurality of chain elements that are sequentially hinged together. In this case, the belt element is bendable because the chain elements are pivotable with respect to each other because they are hinged together, even though the chain elements themselves may be rigid.

According to the invention, the belt element includes at least one flexible cap for capping the at least one printhead. Thereby, one of the at least one flexible cap may be for capping one printhead at a time or may be for capping two or more printheads at a time. In one example, the belt element includes one flexible cap for capping all printheads of the printer or all of the printheads arranged in one print bar of the printer, in case the printer comprises one or more print bars. In another example, the belt element includes one flexible cap per printhead of the printer or per printhead of one print bar of the printer, wherein each flexible cap is for capping another one of the printheads of the printer or another one of the printheads of one print bar of the printer, in case the printer comprises one or more print bar.

According to the invention, the belt element features a resting setting and a capping setting. Advantageously, thereby, the resting setting advantageously different from the capping setting. Furthermore, the resting setting is advantageously a setting of the belt element for freeing the at least one printhead in order to enable printing with the at least one printhead on a printing substrate while the capping setting is advantageously a setting of the belt element for enabling capping of the at least one printhead.

Consequently, in case the capping unit is installed in a printer and the belt element is arranged in the resting setting, the at least one printhead is preferably freed such that printing with the at least one printhead on the printing substrate is enabled. In case the capping unit is arranged in a printer and the belt element is arranged in the capping setting, capping of the at least one printhead is preferably enabled. Thereby, the at least one printhead may be capped merely because the belt element is arranged in the capping setting or the at least one printhead may be enabled to become capped by moving the printhead to a capping position when the belt element is arranged in the capping setting. In this latter case, the printhead can feature the mentioned capping position for capping the at least one printhead when the belt element is arranged in the capping setting and a decapping position for decapping the at least one printhead when the belt element is arranged in the decapping setting. Thus, in this case, when the belt element is in the capping setting, the printhead can be moved to the capping position for capping the printhead and can be moved to the decapping position such that the printhead is decapped.

According to the invention, the belt element provides a self-stability section extending over at least a portion of the belt element's elongated extent. Consequently, the self-stability section is not required to extend over the entire elongated extent of the belt element. The self-stability section can extend only over a fraction of the elongated extent of the belt element. Nonetheless, the self-stability section can also extend over the entire elongated extent of the belt element.

According to the invention, in the self-stability section, the belt element is bendable in a movement plane. This preferably means that the belt element is bendable in its self-stability section and allows for a bending where the elongated extent of the belt element is arranged at least over the self-stability section in the movement plane during bending of the belt element, in particular where the elongated extent of the belt element is arranged at least over the self-stability section in the movement plane at a start of the bending action, during the bending action and at the end of the bending action.

According to the invention, in the capping setting, at all positions within the self-stability section, a course of the elongated extent follows a straight line in the movement plane. Furthermore, in the capping setting, at each position within the self-stability section of the elongated extent of the belt element, the belt element provides a self-stability against bending of the belt element in a self-stability direction being oriented perpendicular to the straight line and being aligned in the movement plane. Thus, the self-stability prevents the belt element in the capping setting of getting bent in the self-stability section in the self-stability direction away from the straight line.

Furthermore, at at least one position within the self-stability section, the belt element is bendable in the movement plane away from the straight line in a bending direction being oriented opposite to the self-stability direction. Thus, the bending direction and the self-stability direction are unidirectional directions and are oriented in opposite directions in space.

The solution according to the invention with the belt element being displaceable to the resting setting and to the capping setting and providing the self-stability has the advantage that a less complex and a less voluminous construction of the capping unit is enabled.

Advantageously, at each position within the self-stability section, the belt element provides a self-stability against bending of the belt element in a local self-stability direction beyond a limit, the local self-stability direction being oriented perpendicular to the course of the elongated extent at the respective position, wherein in the capping setting, at each position within the self-stability section, the local self-stability direction is aligned parallel to the self-stability direction and the limit is a limiting curve being the straight line along which the self-stability section is arranged in said capping setting.

Preferably, the local self-stability directions at the different positions within the self-stability section are unidirectional directions defined locally at each position within the self-stability section. Furthermore, the self-stability direction is preferably a unidirectional direction defined globally with respect to the straight line and the movement plane. Since in the capping setting, at each position within the self-stability section, the local self-stability direction is aligned parallel to the self-stability direction, the local self-stability directions and the self-stability direction all point in a same unidirectional direction in the capping setting.

The belt element providing at each position within the self-stability section a self-stability against bending of the belt element in a local self-stability direction beyond a limit preferably means that when a self-stability reference range within the self-stability section is defined, wherein the self-stability reference range starts at a first self-stability reference position and ends at a second self-stability reference position of the belt element, and when in the capping setting, the belt element is kept at the first self-stability reference position and at the second self-stability reference position on the limiting curve, then, for each position within the self-stability reference range, when an external force is applied to the belt element at the respective position in the local self-stability direction at the respective position, the belt element maximally allows for a deviation of the respective position from the limiting curve in the local self-stability direction at the respective position by an amount of 10% or less, particular preferably 5% or less, and most preferably 1% or less of a length of the self-stability reference range. Thereby, for each position within the self-stability reference range, the deviation of the respective position from the limiting curve in the local self-stability direction at the respective position, which the belt element maximally allows for, is preferably the distance between the point on the limiting curve where the respective position is located in case the belt element is arranged over the entire self-stability section on the limiting curve and the position where the respective position is positioned when the external force is applied to the belt element at the respective position and the belt element is maximally elastically deflected without getting damaged or breaking when the belt element is kept at the first self-stability reference position and at the second self-stability reference position on the limiting curve.

Advantageously, the length of the self-stability section is longer than a length of the self-stability range. In first preferred variant thereof, the length of the self-stability range is 40 cm. In a second preferred variant thereof, the length of the self-stability range is 80 cm. Consequently, in the first preferred variant, the length of the self-stability section is longer than 40 cm, while in the second preferred variant, the length of the self-stability section is longer than 80 cm.

Preferably, the belt element possesses two ends arranged opposite to each other, each end located at another one of the two end of the elongated extent of the belt element. This has the advantage that the belt element can be pulled at one end in order to displace the belt element from the resting setting to the capping setting and/or from the capping setting to the resting setting.

Alternatively, the belt element may go without two ends arranged opposite to each other. In this case, the belt element forms a closed loop. Such an alternative has the advantage that the belt element can be guided around two or more wheels and the at least one flexible cap can easily be moved and positioned for optimally capping the at least one printhead by actuating on or more of the two or more wheels.

Advantageously, at least a part of the at least one flexible cap is arranged within the self-stability section of the belt element. This has the advantage that the part of the at least one flexible cap which is arranged within the self-stability section of the belt element can easily take the forces resulting from the at least one printhead being pressed against the respective part of the at least one flexible cap for capping the at least one printhead. Particular advantageously, the at least one flexible cap is arranged within the self-stability section of the belt element. This has the advantage that all of the at least one flexible cap can easily take the forces resulting from the at least one printhead being pressed against the at least one flexible cap for capping the at least one printhead.

Alternatively, one or more of the at least one flexible cap may be arranged outside of the self-stability section of the belt element.

Preferably, the belt element has a length measured along the elongated extent of the belt element. Furthermore, at each position within the self-stability section, the belt element preferably has a thickness measured in the local self-stability direction at the respective position and a width measured at the respective position in a direction perpendicular to the local self-stability direction and perpendicular to the course of the elongated extent of the belt element at the respective position, wherein at each position within the self-stability section, the width and the thickness of the belt element are both shorter than the length of the belt element, and wherein at each position within a subsection of the self-stability section covering at least 80%, particular preferably at least 90%, most preferably 100% of the self-stability section, the width of the belt element is larger than the thickness of the belt element. Thereby, the subsection can consist of one contiguous region or of two or more regions being separated from each other. This has the advantage that the belt element can be constructed with a small volume while still providing sufficient space over its width for accommodating the at least one flexible cap in a position on the belt element where in the capping setting, the at least one flexible cap can contact the at least one printhead for capping the printhead and where the belt element can take the forces resulting from the at least one printhead being pressed in the self-stability direction against the at least one flexible cap.

Alternatively, the belt element can have a different shape.

Advantageously, in the resting setting, the belt element provides a different shape as compared to in the capping setting. Thus, in the resting setting, the belt element is deformed as compared to in the capping setting. Advantageously, the belt element is bent in the resting setting as compared to in the capping setting, resulting in the different shape in the resting setting as compared to in the capping setting.

The belt element providing a different shape in the resting setting as compared to in the capping setting has the advantage that a compact construction of the capping unit is enabled. This is particular advantageous, in case the capping unit comprises a receiving space for receiving the belt element, wherein in the resting setting, the belt element is located in the receiving space, and wherein in the capping setting, the belt element is located outside of the receiving space.

Advantageously, the at least one flexible cap is arranged along the elongated extent of the belt element. Thereby, the at least one flexible cap can extend over a subportion of the elongated extent of the belt element or over the entire elongated extent of the belt element. Independent of the extent over which the at least one flexible cap extends over the elongated extent of the belt element, this has the advantage that the at least one flexible cap is optimally supported by the rest of the belt element.

Advantageously, the at least one flexible cap is a flat element. This has the advantage that the belt element can be constructed flat and thus space saving while at the same time, the at least one flexible cap provides sufficient surface area for contacting the at least one printhead for capping the at least one printhead.

Alternatively, the at least one flexible cap can have a non-flat shape.

Preferably, the at least one flexible cap includes a sheet metal. This has the advantage that the at least one flexible cap provides a good stability while at the same time, the at least one flexible cap can be designed to enable bending of the flexible cap, thus simplifying arranging the belt element in the resting setting in a different shape as compared to in the capping setting.

Advantageously, the at least one flexible cap includes a sealing material for sealing a nozzle of the least one printhead when capping the at least one printhead. This has the advantage that optimal sealing of the nozzle of the at least one printhead is enabled when capping the at least one printhead.

Advantageously, the sealing material is silicone. This has the advantage that a durable optimal sealing of the nozzle of the at least one printhead is enabled when capping the at least one printhead. Alternatively, however, the sealing material can be any plastic, rubber, or any elastomer.

In case the at least one flexible cap includes a sheet metal and a sealing material for sealing a nozzle of the least one printhead when capping the at least one printhead, the sealing material is advantageously provided in a shape which can be clipped onto the sheet metal, particular advantageously slid onto the sheet metal. This has the advantage that the sealing material can easily be replaced in case the sealing material is damaged or worn down.

Preferably, the belt element comprises a plurality of chain elements that are sequentially hinged together. This has the advantage that the belt element can easily be constructed in a robust way such that the belt element can be bent in that the chain elements are pivotable with respect to each other. Additionally, this has the advantage that by providing stoppers at the chain elements, a pivoting movement of two adjacent chain elements with respect to each other can easily be limited in one direction at a specific limit such that the self-stability against bending of the belt element in the local self-stability direction beyond the limit is provided and such that in the capping setting, the self-stability against bending of the belt element in the self-stability section in the self-stability direction is provided.

In case the belt element comprises a plurality of chain elements that are sequentially hinged together, the belt element preferably comprises a mobile cable handler, a cable chain or a studded link cable chain, wherein the chain elements form the mobile cable handler, cable chain or studded link cable chain.

Alternatively, the belt element can be constructed differently. In this case, the belt element may for example comprise a bendable band.

Advantageously, the capping unit comprises a receiving space for receiving the belt element, wherein in the resting setting, the belt element is located in the receiving space, and wherein in the capping setting, the belt element is located outside of the receiving space. This has the advantage that in the resting setting, the belt element can easily be protected from damages. Thereby, in the resting setting, advantageously at least 80% of a volume of the belt element is located inside the receiving space when the belt element is located in the receiving space, while in the capping setting, advantageously at least 80% of the volume of the belt element is located outside of the receiving space when the belt element is located outside of the receiving space.

In a first preferred variant, the receiving space is defined by a housing which encloses the receiving space, wherein the housing comprises an opening through which the belt element is movable when being displaced from the resting setting to the capping setting and back. In a second preferred variant however, the receiving space may be defined by a rack. This rack can for example be a separate unit or a part of a machine frame of the printer.

Alternatively, the capping unit may go without such a receiving space.

Advantageously, a maintenance device for maintenance of at least one printhead of a printer, in particular an inkjet printer, includes a capping unit according to the invention and a service device for servicing the at least one printhead, the service device comprising one or both of a cleaning unit for cleaning the at least one printhead, in particular for cleaning a nozzle of the at least one printhead, and an adjusting unit for adjusting one or both a position and an orientation of the at least one printhead, in particular the nozzle of the at least one printhead. Thereby, maintenance preferably includes capping and servicing of the at least one printhead.

Particular advantageously, the maintenance device is for maintenance of at least one printhead of an industrial inkjet printer, i.e. an inkjet printer for printing on printing substrates having a width of at least 50 cm, in particular at least 70 cm. Such printing substrates are considered as large printing substrates and can for example be paper webs having a width of at least 50 cm, in particular at least 70 cm, corrugated card board having a width of at least 50 cm, in particular at least 70 cm, or rolls of stickers, the rolls having a width of at least 50 cm, in particular at least 70 cm. Alternatively however, the capping unit can be for capping at least one printhead of any printer or inkjet printer, respectively.

The servicing preferably comprises one or both of cleaning of the at least one printhead, in particular the nozzle of the at least one printhead, and adjusting one or both of a position and an orientation of the at least one printhead, in particular of the nozzle of the at least one printhead. More precisely, in case the service device comprises the cleaning unit, servicing comprises cleaning of the at least one printhead, in particular the nozzle of the at least one printhead, while in case the service device comprises the adjusting unit, servicing comprises adjusting one or both of a position and an orientation of the at least one printhead, in particular the nozzle of the at least one printhead. Of course, in case the service device comprises both the cleaning unit and the adjusting unit, then servicing comprises both cleaning and adjusting. Thereby, the cleaning advantageously comprises purging and wiping of the at least one printhead, in particular the nozzle of the at least one printhead.

Preferably, the service device is a carriage. This has the advantage that the service device can easily be moved to one or more positions for servicing the at least one printhead and moved to one or more other positions for enabling printing and/or capping of the at least one printhead.

Alternatively, the service device can be constructed differently. In one example, the service device is mounted on a robot arm to be moved to one or more positions for servicing the at least one printhead and moved to one or more other positions enabling printing and/or capping of the at least one printhead.

Advantageously, the belt element possesses two ends arranged opposite to each other, each located at another one of the two ends of the elongated extent of the belt element, wherein the service device is arranged at one of the two ends of the belt element. In one example, the service device is attached to the belt element at one of the two ends of the belt element. In another example, the service device is movably mounted to the belt element at one of the two ends of the belt element. In yet another example, the service device is hinged to the belt element at one of the two ends of the belt element. In any case, the service device being arranged at one of the two ends of the belt element has the advantage that the service device can easily be moved together with the belt element such that the maintenance device can be constructed simpler and cheaper. For example, the maintenance device can be constructed with only one actuator for actuating movement of the service device and the belt element.

Alternatively, the service device may be arranged at another place than one of the two ends of the belt element. Furthermore, the belt element may go without two ends but may be designed forming a closed loop.

Preferably, the maintenance device comprises a linear guide along which the belt element is movably mounted for displacing the belt element from the resting setting to the capping setting and back. This has the advantage that displacing the belt element from the resting setting to the capping setting and back can be obtained well controlled with a cost effective and simple construction.

In case the belt element possesses two ends arranged opposite to each other, each located at another one of the two ends of the elongated extent of the belt element, wherein the service device is arranged at one of the two ends of the belt element, then the service device is preferably mounted movable along the linear guide for displacing the belt element from the resting setting to the capping setting and back. This has the advantage that the maintenance device can be constructed with only one actuator for actuating movement of the service device and the belt element.

Advantageously, the maintenance device comprises a belt element actuator for actuating displacement of the belt element from the resting setting to the capping setting and back.

In a first particular advantageous variant, a movement of the service device is actuatable by the belt element actuator, while the displacement of the belt element from the resting setting to the capping setting and back is actuated by the movement of the service device. In a first preferred variation thereof, the belt element actuator is arranged in the service device. In a second preferred variation thereof, the belt element actuator is arranged somewhere else.

In a second particular advantageous variant, the displacement of the belt element from the resting setting to the capping setting and back is actuated by the belt element actuator while the movement of the service device is actuated by the movement of the belt element.

Alternatively, the maintenance device comprises a belt element actuator for actuating displacement of the belt element from the resting setting to the capping setting and back and a service device actuator for actuating movement of the service device.

Preferably a printer, in particular an inkjet printer, includes a print bar comprising at least one printhead and a maintenance device as described in the present text, the maintenance device thus including a capping unit according to the invention. Particular advantageously, the printer is an industrial inkjet printer, i.e. an inkjet printer for printing on printing substrates having a width of at least 50 cm, in particular at least 70 cm. Such printing substrates are considered as large printing substrates and can for example be paper webs having a width of at least 50 cm, in particular at least 70 cm, corrugated card board having a width of at least 50 cm, in particular at least 70 cm, or rolls of stickers, the rolls having a width of at least 50 cm, in particular at least 70 cm.

Advantageously, the length of the self-stability section is in a range from 90% to 110% of a length of the print bar. Particular advantageously, the length of the self-stability section is about 100% of the length of the print bar. This has the advantage that an efficient capping of the at least one printhead of the print bar is ensured.

Alternatively, however, the length of the self-stability section can be longer or shorter than the range from 90% to 110% of the length of the printbar.

Advantageously, the belt element is movable along the print bar for displacing the belt element from the resting setting to the capping setting and back. This has the advantage that the belt element can easily be positioned in the capping setting for capping all printheads of the print bar.

In case the belt element possesses two ends arranged opposite to each other, located at ends of the elongated extent of the belt element, preferable one of the two ends of the belt element is movable from a first end of the print bar to a second end of the print bar for displacing the belt element from the resting setting to the capping setting, wherein in the capping setting, the belt element extends along the print bar. This has the advantage that the belt element can particularly easily be positioned in the capping setting for capping all printheads of the print bar and in the resting setting for freeing the at least one printhead of the print bar in order to enable printing with the at least one printhead of the print bar on a printing substrate. If in addition, the service device is arranged at one of the two ends of the belt element, then preferably the service device with the one of the two ends of the belt element at which the service device is arranged is movable from a first end of the print bar to a second end of the print bar for displacing the belt element from the resting setting to the capping setting, wherein in the capping setting, the belt element extends along the print bar. This has the advantage, that while displacing the belt element from the resting setting to the capping setting or back, the at least one printhead of the print bar can be serviced. Thus, less movement within the entire device and in particular less moving parts are required. Thus, an increased speed of maintenance is achieved and the printer can be constructed simpler and thus for less costs.

In case the maintenance device comprises a linear guide along which the belt element is movably mounted for displacing the belt element from the resting setting to the capping setting and back, the belt element is advantageously mounted movably along the linear guide for being moved along the print bar for displacing the belt element from the resting setting to the capping setting and back. This has the advantage that the printer can be constructed simpler and thus for less costs while at the same time, displacing the belt element from the resting setting to the capping setting and back can be obtained well controlled with a simple construction.

In an alternative, the belt element is movable along a different path than along the print bar for displacing the belt element from the resting setting to the capping setting and back.

Preferably, the at least one printhead, in particular the print bar with the at least one printhead, features a capping position, where the at least one printhead is capped with the at least one flexible cap when the belt element is in the capping setting, and a decapping position, where the at least one printhead is spaced apart from the at least one flexible cap when the belt element is in the capping setting, wherein the at least one printhead, in particular the print bar with the at least one printhead, is displaceable from the capping position to the decapping position and back. This has the advantage that in a simple way, a controlled capping and decapping can be achieved, since the belt element is positioned in the capping setting first. Additionally, this has the advantage that the maintenance unit can comprise the linear guide for moving the belt element along the print bar for displacing the belt element from the resting setting to the capping setting and back, while the at least one print head, in particular the print bar with the at least one printhead can be constructed to be movable in a direction perpendicular to along the print bar for displacing the at least one printhead, in particular the print bar with the at least one printhead from the capping position to the decapping position and back. Thus, the printer can be constructed more compact.

Alternatively, the at least one printhead, in particular the print bar with the at least one printhead, may not feature such a capping position and such a decapping position. Rather, the at least one printhead, in particular the print bar with the at least one printhead, may for example be arranged at a fixed position or may feature a rest position and a printing position, wherein the at least one printhead is capped by mere displacement of the belt element in the capping setting.

Advantageous, the printer comprises a machine frame, wherein the at least one printhead, in particular the print bar with the at least one printhead, is movably mounted to the machine frame for being displaced from the capping position to the decapping position and back. This has the advantage that a robust mounting of the printhead, in particular the print bar with the at least one printhead, is achieved.

Alternatively, the printer may comprise a machine frame while the at least one printhead, in particular the printbar with the at least one printhead, is mounted differently. Or, the printer may even go without a machine frame.

Advantageously, the printer comprises a printhead actuator for actuating displacement of the at least one printhead, in particular the print bar with the at least one printhead, from the capping position to the decapping position and back. This has the advantage that the at least one printhead, in particular the print bar with the at least one printhead can easily by displaced from the capping position to the decapping position and back.

Alternatively, the printer may go without such a printhead actuator. In this case, the at least one printhead, in particular the print bar with the at least one printhead, may be manually displaceable from the capping position to the decapping position and back.

Preferably, the at least one printhead, in particular the print bar with the at least one printhead, is movable in a printhead movement direction for being displaced from the decapping position to the capping position and movable in a direction opposite to the printhead movement direction for being displaced from the capping position to the decapping position. Thereby, the printhead movement direction is preferably aligned in the movement plane. Thus, a reliable capping of the at least one printhead is achieved.

Advantageously, when a cone is defined rotation symmetrically around the movement direction with an opening in the movement direction, wherein an angle between the movement direction and a mantle of the cone is 10°, then the self-stability direction is advantageously oriented within this cone. Particular advantageously, the self-stability direction and the movement direction are oriented the same. Furthermore, when the cone is defined rotation symmetrically around the movement direction with the opening in the movement direction, wherein the angle between the movement direction and the mantle of the cone is 10°, then, in the capping setting, at each position within the self-stability section, the local self-stability direction is advantageously oriented within this cone. In this latter case, in the capping setting, the local self-stability direction and the movement direction are particular advantageously oriented the same.

Advantageously, the printhead movement direction is oriented vertically. Hereby, a simple construction of the printer is enabled. In a variant however, the printhead movement direction is oriented differently in space.

Alternatively, the printhead movement direction may be oriented in a direction not aligned in the movement plane.

Other advantageous embodiments and combinations of features come out from the detailed description below and the entirety of the claims.

BRIEF DESCRIPTION OF THE DRAWINGS

The drawings used to explain the embodiments show.

In the figures, the same components are given the same reference symbols.

PREFERRED EMBODIMENTS

Figure 1A:
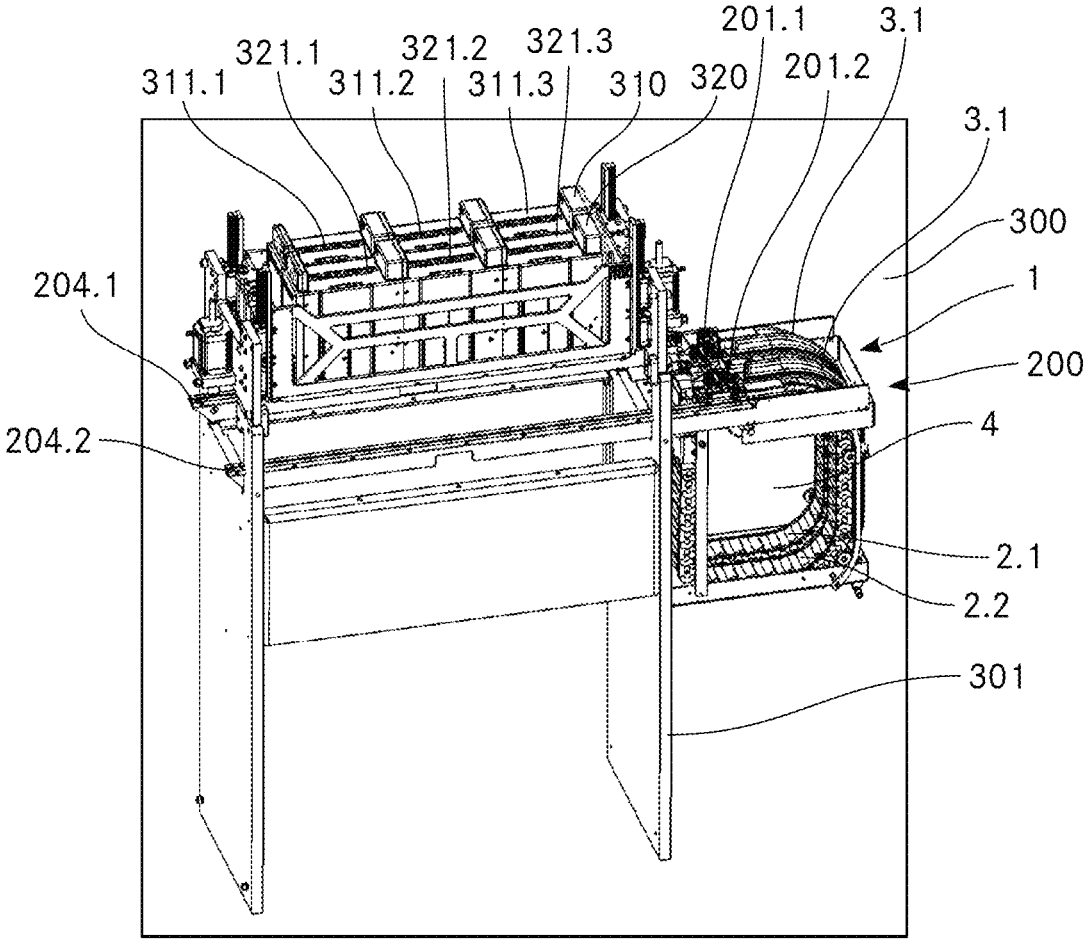
FIG. 1*a*, 1*b* each an oblique view of a maintenance device with a capping unit according to the invention implemented in an industrial inkjet printer having two print bars each with three printheads, once with belt elements in a resting setting and once with the belt elements in a capping setting.
Figure 1B:
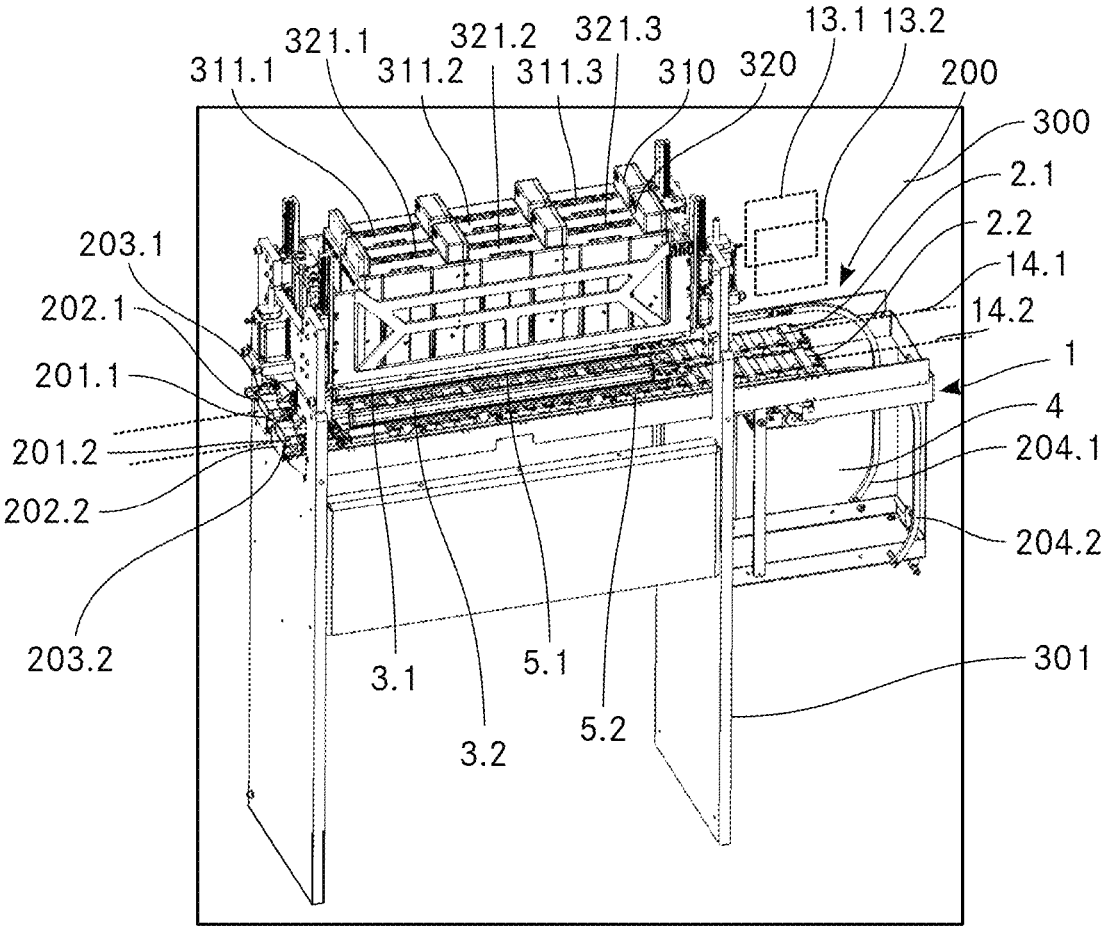

FIGS. 1*a* and 1*b* each show an oblique view of a maintenance device 200 with a capping unit 1 according to the invention implemented in an industrial inkjet printer 300 having two print bars 310, 320 each with three printheads 311.1, 311.2, 311.3, 321.1, 321.2, 321.3. In both figures, the industrial inkjet printer 300 as such is only schematically indicated with a square. In both figures, a part of a machine frame 301 of the industrial inkjet printer 300 is shown in more detail. Furthermore, the two print bars 310, 320 with the printheads 311.1, 311.2, 311.3, 321.1, 321.2, 321.3 are shown in more detail, too. The further details of the industrial inkjet printer 300 are not shown in the figures because they are known from known industrial inkjet printers. These industrial inkjet printers as the present industrial inkjet printer 300 are for printing on printing substrates in the form of paper webs having a width of 150 cm. Other printing substrates are possible, too. In variants, the printing substrates are for example corrugated cardboard having a width of 150 cm or rolls of stickers, the rolls having a width of 150 cm. In variants, the industrial inkjet printer can also be for printing on printing substrates having a smaller width like 70 cm or 50 cm or widths even bigger than 150 cm.

The capping unit 1 comprises two belt elements 2.1, 2.2, each having an elongated extent. These belt elements 2.1, 2.2 each comprise a plurality of chain elements that are sequentially hinged together and which each form a cable chain. Both belt elements 2.1, 2.2 have a length measured along the elongated extent of the respective belt element 2.1, 2.2 and possess two ends arranged opposite to each other, each end located at another one of the two ends of the elongated extent of the respective belt element 2.1, 2.2.

The belt elements 2.1, 2.2 each comprise a flexible cap 3.1, 3.2 for capping the printheads 311.1, 311.2, 311.3, 321.1, 321.2, 321.3 of a respective one of the print bars 310, 320. These flexible caps 3.1, 3.2 are arranged along the elongated extent of the respective belt element 2.1, 2.2 and extend over a subportion of the elongated extent of the respective belt element 2.1, 2.2. The flexible caps 3.1, 3.2 are flat elements and include each a sheet metal with silicone as sealing material for sealing nozzles of the printheads 311.1, 311.2, 311.3, 321.1, 321.2, 321.3 of the respective print bar 310, 320 when capping the printheads 311.1, 311.2, 311.3, 321.1, 321.2, 321.3. Thereby, the sealing material provides a shape which can be slid onto the sheet metal and is slid on the sheet metal. Instead of silicone as sealing material, other sealing materials like plastic, rubber or any elastomer are possible, too.

In FIG. 1*a*, the belt elements 2.1, 2.2 are arranged in a resting setting, while in FIG. 1*b*, the belt elements 2.1, 2.2 are arranged in a capping setting. In the resting setting, the belt elements 2.1, 2.2 are moved away from the print bars 310, 320 outside a longitudinal end of the print bars 310, 320. Thereby, an underside of the printheads 311.1, 311.2, 311.3, 321.1, 321.2, 321.3, where the nozzles for printing are arranged, is freed. Thus, the printheads 311.1, 311.2, 311.3, 321.1, 321.2, 321.3 are freed and printing on a printing substrate (not shown) is enabled. As visible in FIG. 1*a*, the belt elements 2.1, 2.2 are located in the resting setting in a receiving space 4. Thereby, the belt elements 2.1, 2.2 with their entire volume are located inside the receiving space 4. In other variants however, the belt elements 2.1, 2.2 can also be located with 80% or more than 80% within the receiving space 4.

In the capping setting, the belt elements 2.1, 2.2 each extend below the printheads 311.1, 311.2, 311.3, 321.1, 321.2, 321.3 along the print bars 310, 320. Thus, each belt element 2.1, 2.2 enables capping of the printheads 311.1, 311.2, 311.3, 321.1, 321.2, 321.3 of its respective print bar 310, 320.

As visible in FIGS. 1*a* and 1*b*, the maintenance device 200 comprises two service devices 201.1, 201.2 for servicing the printheads 311.1, 311.2, 311.3, 321.1, 321.2, 321.3. Thereby, one of the service devices 201.1 is mounted to a first end of one of the belt elements 2.1, while the other one of the service devices 201.2 is mounted to a first end of the other one of the belt elements 2.2. Thus, each one of the service devices 201.1, 201.2 is for servicing the printheads 311.1, 311.2, 311.3, 321.1, 321.2, 321.3 of a respective one of the print bars 310, 320. Cables for supplying the service devices 201.1, 201.2 with power and with control signals from a controller (not shown) are placed in the respective cable chain of the respective belt element 2.1, 2.2. In one example, the controller for providing the control signals is formed by a separate personal computer. In another example, the controller for providing the control signals is part of the industrial inkjet printer 300. In this latter example, the controller for providing the control signals is incorporated in a control module of the industrial inkjet printer 300 which is used to control the operation of the industrial inkjet printer 300 in the same way as known from known industrial inkjet printers.

Each one of the service devices 201.1, 201.2 comprises a cleaning unit 202.1, 202.2 for cleaning the nozzles of the respective printheads 311.1, 311.2, 311.3, 321.1, 321.2, 321.3 and an adjusting unit 203.1, 203.2 for adjusting both a position and an orientation of the respective printheads 311.1, 311.2, 311.3, 321.1, 321.2, 321.3 and/or nozzles of the respective printheads 311.1, 311.2, 311.3, 321.1, 321.2, 321.3. Service devices 201.1, 201.2 with such a cleaning unit 202.1, 202.2 and such an adjusting unit 203.1, 203.2 are known in the art.

Both service devices 201.1, 201.2 are carriages and mounted movably along linear guides 204.1, 204.2 of the maintenance device 200. These linear guides 204.1, 204.2 are attached to the machine frame 301 of the industrial inkjet printer 300. They are arranged below the print bars 310, 320 and oriented horizontally along the print bars 310, 320 and extend into the receiving space 4, where they are bent downwards. Besides the service devices 201.1, 201.2, also the belt elements 2.1, 2.2 are mounted movably along the linear guides 204.1, 204.2. Thereby, the belt elements 2.1, 2.2 are each mounted with three small carriages 9.1, 9.2 (see FIG. 4) movably to the linear guides 204.1, 204.2, wherein the small carriages are positioned at positions spaced apart from each other along the elongated extent of the respective belt element 2.1, 2.2.

In order to displace the belt elements 2.1, 2.2 from the resting setting to the capping setting and back, the belt elements 2.1, 2.2 are movable along the linear guides 204.1, 204.2. Thereby, belt element actuators are included in the service devices 201.1, 201.2 and actuate a movement of the service devices 201.1, 201.2 along the linear guides 204.1, 204.2. As visible in FIG. 1 a, in the resting setting, the belt elements 2.1, 2.2 are located with the service devices 201.1, 201.2 inside the receiving space 4 at a longitudinal end of the print bars 310, 320. In order to displace the belt elements 2.1, 2.2 to the capping setting, the service devices 201.1, 201.2 are actuated by the belt element actuators and thus moved to the other longitudinal end of the print bars 310, 320. During this movement of the service devices 201.1, 201.2, the belt elements 2.1, 2.2 are pulled by the service devices 201.1, 201.2 and displaced to the capping setting. In order to displace the belt elements 2.1, 2.2 back to the resting setting, the service devices 201.1, 201.2 are moved back to the receiving space 4 and push the belt elements 2.1, 2.2 into the receiving space 4 and to the resting setting.

Since the linear guides 204.1, 204.2 are oriented horizontally along the print bars 310, 320, the part of the belt elements 2.1, 2.2 which is located in the capping setting below the print bars 310, 320 extends in the capping setting along a straight line 14.1, 14.2. These straight lines 14.1, 14.2 are indicated in FIG. 1*b* as dashed lines. Since the linear guides 204.1, 204.2 extend into the receiving space 4 where they are bent downwards, the part of the belt elements 2.1, 2.2 which is located in the capping setting below the print bars 310, 320 follows in the resting setting the linear guides 204.1, 204.2 and is thus in the resting setting bent downwards. For this reason, the belt elements 2.1, 2.2 provide a different shape in the resting setting as compared to in the capping setting. In order to enable these different shapes of the belt elements 2.1, 2.2, the belt elements 2.1, 2.2 comprise as already mentioned chain elements that are sequentially hinged together. These chain elements are pivotable with respect to each other, enabling a bending of the belt elements 2.1, 2.2 in a movement plane 13.1, 13.2 assigned to the respective belt element 2.1, 2.2 in order to allow for the different shapes of the belt elements 2.1, 2.2. In the present example of the capping unit 1, the belt elements 2.1, 2.2 are mounted movably along the linear guides 204.1, 204.2 of the maintenance device 200. Thereby, the movement planes 13.1, 13.2 are oriented vertically and run parallel to the print bars 310, 320. In FIG. 1*b*, the movement planes 13.1, 13.2 are each indicated in the form of a square of dashed lines, showing the orientation of the respective movement plane 13.1, 13.2 in space. The squares of dashed lines thus do not show circumferential lines of the respective movement plane 13.1, 13.2 but are to be understood as depicting a square shape on the respective movement plane 13.1, 13.2, thus visualising the orientation of the respective movement plane 13.1, 13.2 in space.

Both belt elements 2.1, 2.2 provide a self-stability section 5.1, 5.2 of the elongated extent of the respective belt element 2.1, 2.2. These self-stability sections 5.1, 5.2 extend over the part of the belt elements 2.1, 2.2 which is located in the capping setting below the print bars 310, 320. Thus, the self-stability sections 5.1, 5.2 each provide a length of about 150 cm which is about 100% of a length of the print bars 310, 320 and within a range from 90% to 110% of the length of the print bars 310, 320. In variants, the self-stability sections 5.1, 5.2 may also extend over a longer part of the elongated extent of the belt elements 2.1, 2.2 or over the entire elongated extent of the belt elements 2.1, 2.2.

In the capping setting, at each position within the respective self-stability section 5.1, 5.2, the belt elements 2.1, 2.2 provide a self-stability against bending of the respective belt element 2.1, 2.2 in a self-stability direction being oriented perpendicular to the respective straight line 14.1, 14.2 along which the respective belt element 2.1, 2.2 is arranged in the capping setting and being aligned in the respective movement plane 13.1, 13.2. Furthermore, at at least one position within the respective self-stability section 5.1, 5.2, the belt elements 2.1, 2.2 are bendable in the respective movement plane 13.1, 13.2 away from the respective straight line 14.1, 14.2 in a bending direction being oriented opposite to the self-stability direction.

In the same sense, at each position within the self-stability sections 5.1, 5.2, the belt elements 2.1, 2.2 provide a self-stability against bending of the respective belt element 2.1, 2.2 in a local self-stability direction beyond a limit which is a limiting curve being the respective straight line 14.1, 14.2, wherein the limiting curve provides a length corresponding to a length of the respective self-stability section 5.1, 5.2.

At each position within the self-stability sections 5.1, 5.2, the local self-stability direction is oriented perpendicular to a course of the elongated extent of the respective belt element 2.1, 2.2 at the respective position. Thereby, the local self-stability directions at the different positions within the self-stability sections 5.1, 5.2 are unidirectional directions defined locally at each position within the respective self-stability section 5.1, 5.2. However, in the capping setting, at each position within the self-stability section 5.1, 5.2 of the respective belt element 2.1, 2.2, the local self-stability direction is aligned parallel to the globally defined self-stability direction. In the present case, the self-stability direction and in the capping setting, all local self-stability directions are directed vertically downward. In other variants, they may all be directed in one and the same direction in space which differs from vertically downward.

As mentioned, the belt elements 2.1, 2.2 provide at each position within their respective self-stability section 5.1, 5.2 a self-stability against bending of the respective belt element 2.1, 2.2 in a local self-stability direction beyond a limit. This means in the present example that when a self-stability reference range within the self-stability section 5.1, 5.2 is defined, the self-stability range having a length of 40 cm, the self-stability reference range starting at a first self-stability reference position and ending at a second self-stability reference position of the respective belt element 2.1, 2.2, and when in the capping setting, the respective belt element 2.1, 2.2 is kept at the first self-stability reference position and at the second self-stability reference position on the limiting curve, then, for each position within the self-stability reference range, when an external force is applied to the respective belt element 2.1, 2.2 at the respective position in the local self-stability direction at the respective position, the respective belt element 2.1, 2.2 maximally allows for a deviation of the respective position from the limiting curve in the local self-stability direction at the respective position by an amount of 1% of a length of the self-stability reference range. In other variants, the respective belt element 2.1, 2.2 maximally allows for a deviation of the respective position from the limiting curve in the local self-stability direction at the respective position by an amount of 10% or 5% of a length of the self-stability reference range. For each position within the self-stability range, the deviation of the respective position from the limiting curve in the local self-stability direction at the respective position, which the respective belt element 2.1, 2.2 maximally allows for, is the distance between the point on the limiting curve where the respective position is located in case the respective belt element 2.1, 2.2 is arranged over the entire respective self-stability section 5.1, 5.2 on the limiting curve and the position where the respective position is positioned when the external force is applied to the respective belt element 2.1, 2.2 at the respective position and the respective belt element 2.1, 2.2 is maximally elastically deflected without getting damaged or breaking when the respective belt element 2.1, 2.2 is kept at the first self-stability reference position and on the second self-stability reference position on the limiting curve. Thereby, in the present example, the length of the self-stability reference range is 40 cm. In a variant however, the length of the self-stability reference range is 80 cm or even different from 40 cm and 80 cm. In any case, the length of the self-stability sections 5.1, 5.2 is longer than the length of the self-stability reference range.

At each position within the self-stability sections 5.1, 5.2, the belt elements 2.1, 2.2 each have a thickness measured in the self-stability direction at the respective position and a width measured at the respective position in a direction perpendicular to the self-stability direction and perpendicular to the course of the elongated extent of the respective belt element 2.1, 2.2 at the respective position, wherein at each position within the respective self-stability section 5.1, 5.2, the width and the thickness of the respective belt element 2.1, 2.2 are both shorter than the length of the respective belt element 2.1, 2.2, and wherein at each position within a subsection of the self-stability section 5.1, 5.2 of the respective belt element 2.1, 2.2 which covers more than 85% of the respective self-stability section 5.1, 5.2, the width of the respective belt element 2.1, 2.2 is larger than the thickness of the respective belt element 2.1, 2.2. Thereby, the subsection consists of several regions being separated from each other, each extending over a part of one of the chain elements.

Figure 2A:
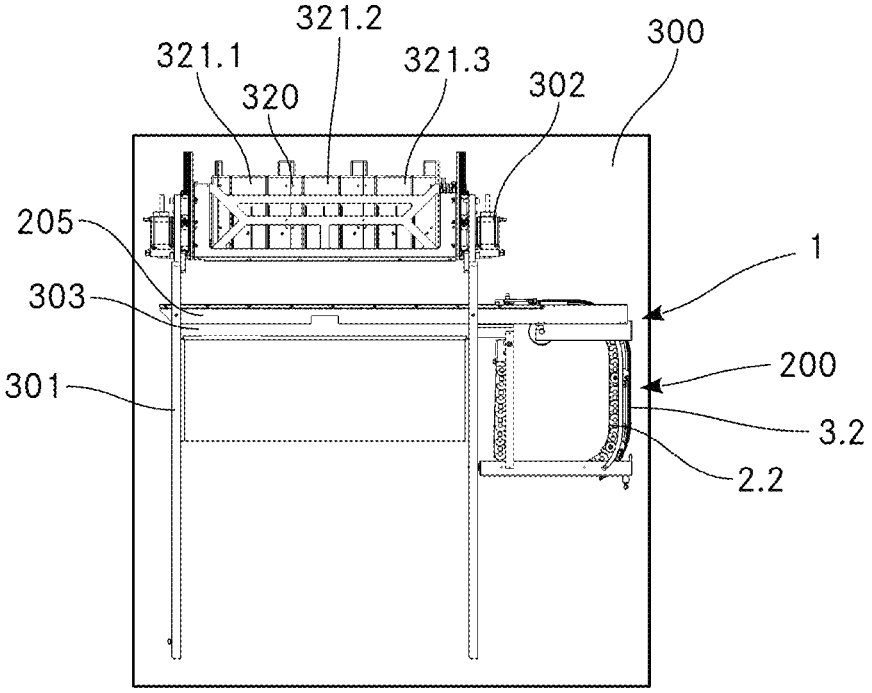
FIG. 2*a, b, c* each a frontal view of the maintenance device with the capping unit according to the invention implemented in the industrial inkjet printer from FIGS. 1*a* and 1*b*, once with the belt elements in the resting setting, once with the belt elements in the capping setting and the print bars with the printheads in a decapping position and once with the belt elements in the capping setting and the print bars with the printheads in a capping position, FIG. 3 a detail view of an end of one of the belt elements with the belt element in the capping setting, and FIG. 4 a detail view of a sidewall being shown transparent at two places such that one of the belt elements in the capping setting behind the sidewall is visible.
Figure 2B:
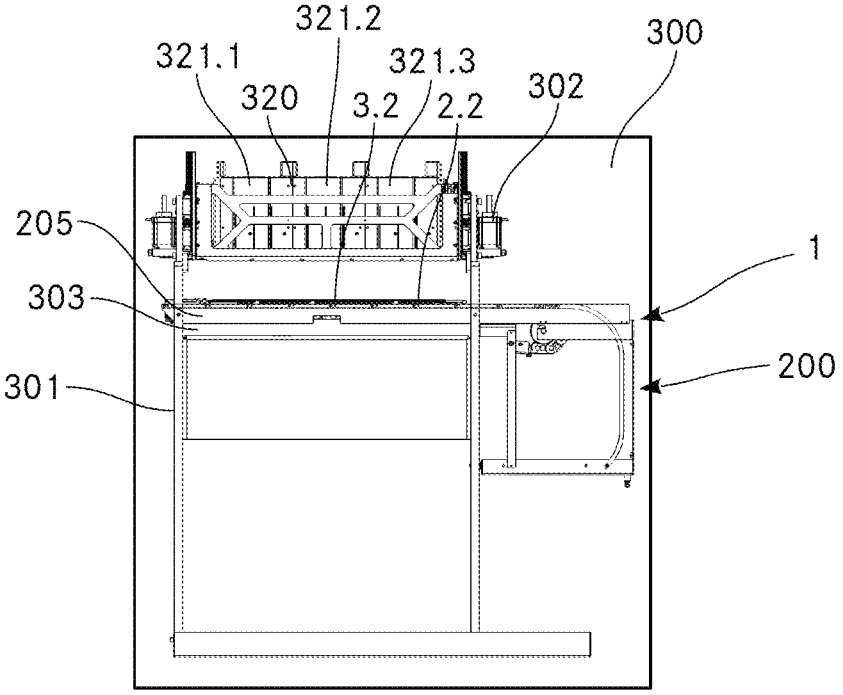
Figure 2C:
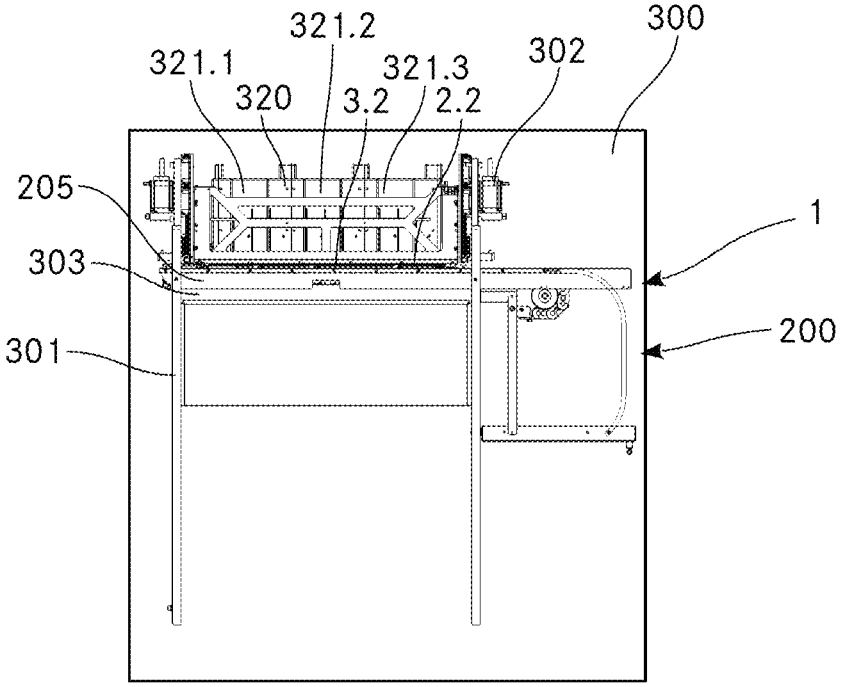

FIGS. 2*a*, 2*b* and 2*c* each show a frontal view of the maintenance device 200 with the capping unit 1 according to the invention implemented in the industrial inkjet printer 300 introduced in FIGS. 1*a* and 1*b*. Again, the industrial inkjet printer 300 is only shown schematically. In FIG. 2*a*, the belt elements 2.2 are shown in the resting setting, while in FIGS. 2*b* and 2*c*, the belt elements 2.2 are shown in the capping setting. In FIGS. 2*a* and 2*b*, the print bars 320 with the printheads 321.1, 321.2, 321.3 are shown in a decapping position, while in FIG. 2*c*, the print bars 320 with the printheads 321.1, 321.2, 321.3 are shown in a capping position.

The print bars 320 with the printheads 321.1, 321.2, 321.3 are mounted movably in vertical direction on the machine frame 301 of the industrial inkjet printer 300 in order to displace the print bars 320 with the printheads 321.1, 321.2, 321.3 from the capping position to the decapping position and back. In the decapping position, the print bars 320 with the printheads 321.1, 321.2, 321.3 are located at a position well above the location of the belt elements 2.1, 2.2 in the capping setting such that there is a gap between the printheads 321.1, 321.2, 321.3 and the respective belt element 2.1, 2.2 (FIG. 2*b*). In the capping position, the print bars 320 with the printheads 321.1, 321.2, 321.3 are moved in a printhead movement direction vertically downward to their capping position. In case the print bars 320 with the printheads 321.1, 321.2, 321.3 are in the capping position and the belt elements 2.1, 2.2 are in the capping setting, the nozzles of the printheads 321.1, 321.2, 321.3 touch the flexible caps 3.2 of the belt elements 2.2. As a result, the printheads 321.1, 321.2, 321.3 are capped by the flexible caps 3.2 (see FIG. 2*c*).

In order to actuate the displacement of the print bars 320 with the printheads 321.1, 321.2, 321.3 from the capping position to the decapping position and back, the industrial inkjet printer 300 comprises a printhead actuator 302.

As visible in FIGS. 2*a*, 2*b* and 2*c*, the maintenance device 200 comprises sidewalls 205 arranged below the print bars 320 and is oriented horizontally along the print bars 320. These sidewalls 205 cover lateral sides of the belt elements 2.2 in the capping setting. Below the sidewalls 205 and below the location of the belt elements 2.2 in the capping setting, there is an opening 303. When printing with the industrial inkjet printer 300, the printing substrate (not shown) is moved through this opening 303 in a direction perpendicular to the plane of the figures. In order to enable printing on the printing substrate, the print bars 320 with the printheads 321.1, 321.2, 321.3 can be moved further down than the capping position onto the printing substrate when the belt elements 2.2 are in the resting setting.

Figure 3:
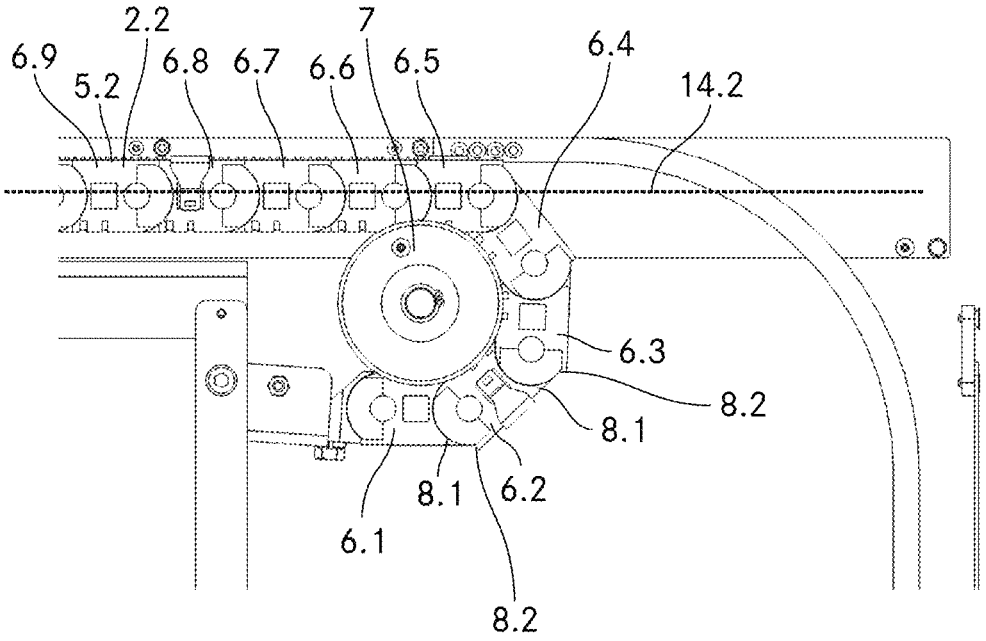

FIG. 3 shows a detail view of an end of one of the belt elements 2.2 with the belt element 2.2 in the capping setting. In this detail view, some of the chain elements 6.1, . . . 6.9 of the belt element 2.2 are visible. Thereby, the five chain elements 6.1, . . . , 6.5 closest to the end of the belt element 2.2 are pivoted with respect to each other and guided around a roll 7. The chain elements 6.6, . . . 6.9 further away from the end of the belt element 2.2 are aligned on the straight line 14.2. The self-stability section 5.2 of the belt element 2.2 is formed by such chain elements 6.8, 6.9 being aligned on the straight line 14.2.

In the view of FIG. 3, it is visible that each of the chain elements 6.1, . . . , 6.9 comprises at each end a stopper 8.1, 8.2. When the chain elements 6.1, . . . , 6.9 are pivoted with respect to each other like the five chain elements 6.1, . . . , 6.5 closest to the end of the belt element 2.2 shown in FIG. 3, then the stoppers 8.1, 8.2 of adjacent chain elements 6.1, . . . , 6.9 are distanced from each other. In case the chain elements 6.1, . . . , 6.9 are aligned on the straight line 14.2 as shown in FIG. 3 for the chain elements 6.5, . . . , 6.9 further away from the end of the belt element 2.2, the stoppers 8.1, 8.2 are in abutment with each other. Thus, the two adjacent chain elements 6.1, . . . , 6.9 can only be pivoted away from the straight line 14.2 in one direction while in the other direction, the stoppers 8.1, 8.2 prevent and thus limit a pivotal movement of the adjacent chain elements 6.1, . . . , 6.9. Consequently, due to the stoppers 8.1, 8.2, the belt elements 2.2 provide the self-stability against bending of the respective belt element 2.2 in the self-stability direction and local self-stability direction beyond the limit of the straight line 14.2.

Figure 4:
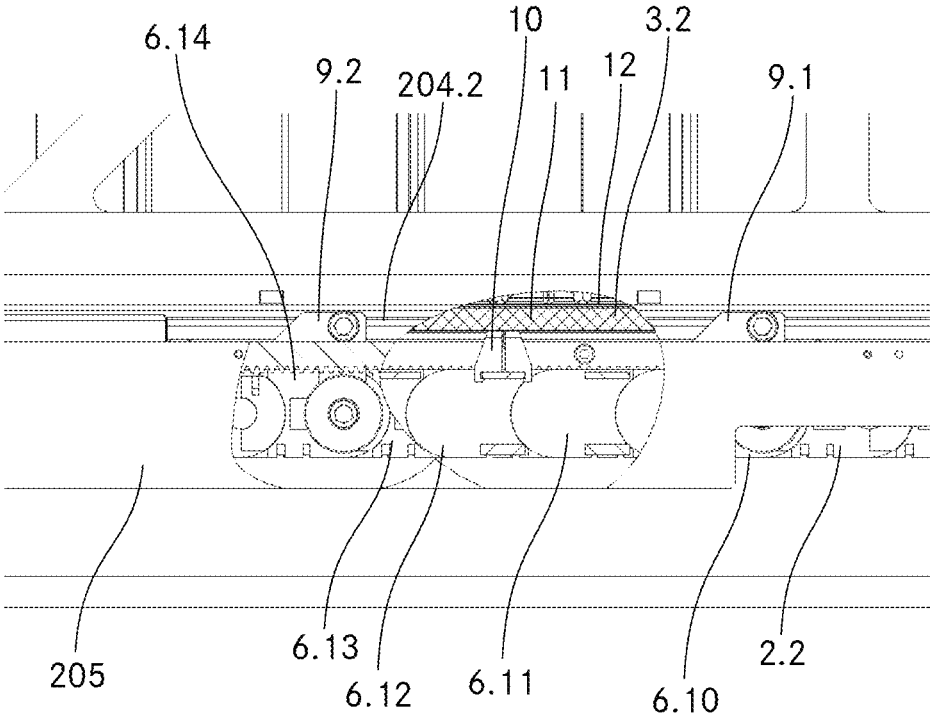

FIG. 4 shows a detail view of the sidewall 205 being shown transparent at two places such that the belt element 2.2 in the capping setting behind the sidewall 205 is visible. In this figure, further chain elements 6.10, . . . , 6.14 of the belt element 2.2 are visible. Two of these chain elements 6.10, 6.14 each comprise one of the small carriages 9.1, 9.2 with which the belt element 2.2 is mounted to the linear guide 204.2. Furthermore, a mounting element 10 with which sheet metal 11 of the flexible cap 3.2 is mounted to one of the chain elements 6.12 is visible. Furthermore, the capping material 12 slid on the sheet metal 11 is visible, too.

The invention is not limited to the embodiment with the capping unit 1, the maintenance device 200 and the industrial inkjet printer 300 shown in the figures. Many other embodiments are readily accessible to a person skilled in the art, too.

In summary, it is to be noted that a capping unit pertaining to the technical field initially mentioned that can be constructed simpler and more compact is provided.

The invention claimed is:

1. A capping unit for capping at least one printhead of a printer, the capping unit comprising:

a belt element, including a plurality of chain elements that are sequentially hinged together, and having an elongated extent, wherein the belt element includes at least one flexible cap for capping said at least one printhead, wherein the belt element is configured to be set in a resting setting and a capping setting, and is displaceable between the resting setting and the capping setting, wherein the belt element provides a self-stability section extending over at least a portion of the elongated extent of the belt element, wherein, in the self-stability section, the belt element is bendable in a movement plane, wherein, in the capping setting, at all positions within the self-stability section, a course of the elongated extent follows a straight line in the movement plane, wherein, in the capping setting, at each position within the self-stability section, the belt element provides a self-stability against bending of the belt element in a self-stability direction, the self-stability direction being oriented perpendicular to the straight line and being aligned in the movement plane, wherein, at at least one position within the self-stability section, the belt element is bendable in the movement plane away from the straight line in a bending direction, the bending direction being oriented opposite to the self-stability direction, and at each position within the self-stability section, the belt element provides a self-stability against bending of the belt element in a local self-stability direction beyond a limit, the local self-stability direction being oriented perpendicular to the course of the elongated extent at each respective position, and in the capping setting, at each position within the self-stability section, the local self-stability direction is aligned parallel to the self-stability direction and the limit is a limiting curve being the straight line, and wherein stoppers are provided at the chain elements, by which a pivoting movement of two adjacent chain elements with respect to each other can be limited in one direction at a specific limit such that the self-stability against bending of the belt element in the local self-stability direction beyond the limit is provided.

2. The capping unit of claim 1, wherein, in the resting setting, the belt element provides a different shape as compared to in the capping setting.

3. The capping unit of claim 1, wherein the at least one flexible cap is arranged along the elongated extent of the belt element.

4. The capping unit of claim 1, wherein the at least one flexible cap includes a sheet metal.

5. The capping unit of claim 1, wherein the at least one flexible cap includes a sealing material for sealing a nozzle of the least one printhead when capping the at least one printhead.

6. The capping unit of claim 1, further comprising a receiving space for receiving the belt element, wherein, in the resting setting, the belt element is located in the receiving space, and, in the capping setting, the belt element is located outside of the receiving space.

7. A maintenance device for maintenance of the at least one printhead of the printer, the maintenance device comprising:

a capping unit as claimed in claim 1 for capping the at least one printhead; and a service device for servicing the at least one printhead, the service device comprising one or both of:

a cleaning unit for cleaning the at least one printhead, and an adjusting unit for adjusting one or both of a position and an orientation of the at least one printhead.

8. The maintenance device of claim 7, wherein the service device is a carriage.

9. The maintenance device of claim 7, wherein the belt element possesses two ends arranged opposite to each other, each end being located at one of two ends of the elongated extent of the belt element, wherein the service device is arranged at one of the two ends of the belt element.

10. The maintenance device of claim 7, further comprising a linear guide along which the belt element is movably mounted for displacing the belt element between the resting setting and the capping setting.

11. A printer comprising:

a print bar comprising at least one printhead; and a maintenance device as claimed in claim 7.

12. The printer of claim 11, wherein the belt element is movable along the print bar for displacing the belt element between the resting setting and the capping setting.

13. The printer of claim 11, wherein the at least one printhead is configured to be positioned in:

a capping position, where the at least one printhead is capped with the at least one flexible cap when the belt element is in the capping setting, and a decapping position, where the at least one printhead is spaced apart from the at least one flexible cap when the belt element is in the capping setting, wherein the at least one printhead is displaceable between the capping position and the decapping position.

14. A capping unit for capping at least one printhead of a printer, the capping unit comprising:

a belt element, including a plurality of chain elements that are sequentially hinged together, and having an elongated extent, wherein the belt element includes at least one flexible cap for capping said at least one printhead, wherein the belt element is configured to be set in a resting setting and a capping setting, and is displaceable between the resting setting and the capping setting, wherein the belt element provides a self-stability section extending over at least a portion of the elongated extent of the belt element, wherein, in the self-stability section, the belt element is bendable in a movement plane, wherein, in the capping setting, at all positions within the self-stability section, a course of the elongated extent follows a straight line in the movement plane, wherein, in the capping setting, at each position within the self-stability section, the belt element provides a self-stability against bending of the belt element in a self-stability direction, the self-stability direction being oriented perpendicular to the straight line and being aligned in the movement plane, wherein, at at least one position within the self-stability section, the belt element is bendable in the movement plane away from the straight line in a bending direction, the bending direction being oriented opposite to the self-stability direction, and stoppers are provided at the chain elements, by which a pivoting movement of two adjacent chain elements with respect to each other can be limited in one direction at a specific limit such that the self-stability against bending of the belt element in a local self-stability direction beyond the limit is provided.

15. The capping unit of claim 14, wherein the at least one flexible cap includes a sheet metal.

16. The capping unit of claim 14, wherein the at least one flexible cap includes a sealing material for sealing a nozzle of the least one printhead when capping the at least one printhead.

17. The capping unit of claim 14, wherein, in the resting setting, the belt element provides a different shape as compared to in the capping setting.

18. A capping unit for capping at least one printhead of a printer, the capping unit comprising:

a belt element having an elongated extent, wherein the belt element includes at least one flexible cap including a sheet metal for capping said at least one printhead, wherein the belt element is configured to be set in a resting setting and a capping setting, and is displaceable between the resting setting and the capping setting, and lateral sides of the belt element are covered by at least one sidewall when in the capping setting, wherein the belt element provides a self-stability section extending over at least a portion of the elongated extent of the belt element, wherein, in the self-stability section, the belt element is bendable in a movement plane, wherein, in the capping setting, at all positions within the self-stability section, a course of the elongated extent follows a straight line in the movement plane, wherein, in the capping setting, at each position within the self-stability section, the belt element provides a self-stability against bending of the belt element in a self-stability direction, the self-stability direction being oriented perpendicular to the straight line and being aligned in the movement plane, wherein, at at least one position within the self-stability section, the belt element is bendable in the movement plane away from the straight line in a bending direction, the bending direction being oriented opposite to the self-stability direction, and the sheet metal is mounted to the belt element with a mounting element.

19. The capping unit of claim 18, wherein, in the resting setting, the belt element provides a different shape as compared to in the capping setting.

20. The capping unit of claim 18, wherein the at least one flexible cap is arranged along the elongated extent of the belt element.

* * * * *